US011129768B1

(12) United States Patent
Gresham

(10) Patent No.: US 11,129,768 B1
(45) Date of Patent: Sep. 28, 2021

(54) FOOT-MASSAGING DEVICE

(71) Applicant: Darryl Gresham, Houston, TX (US)

(72) Inventor: Darryl Gresham, Houston, TX (US)

( * ) Notice: Subject to any disclaimer, the term of this patent is extended or adjusted under 35 U.S.C. 154(b) by 921 days.

(21) Appl. No.: 15/877,454

(22) Filed: Jan. 23, 2018

(51) Int. Cl.
*A61H 23/00* (2006.01)
*A61H 23/02* (2006.01)
*A61H 15/00* (2006.01)

(52) U.S. Cl.
CPC ..... *A61H 23/004* (2013.01); *A61H 15/0078* (2013.01); *A61H 23/0254* (2013.01); *A61H 2015/0014* (2013.01); *A61H 2201/0207* (2013.01); *A61H 2201/10* (2013.01); *A61H 2201/164* (2013.01); *A61H 2205/106* (2013.01); *A61H 2205/12* (2013.01)

(58) Field of Classification Search
CPC .... A61H 23/00–06; A61H 15/00–0092; A61H 2015/0007–0092; A61H 2205/10; A61H 2205/106; A61H 2205/12; A61H 2201/164; A61H 2201/0207; A61H 2201/10; A61H 2203/0456; A61H 2203/0468; A61G 7/00
USPC ..... 601/15
See application file for complete search history.

(56) References Cited

U.S. PATENT DOCUMENTS 4,030,487 A * 6/1977 McEachran ..... 601/15
4,660,548 A * 4/1987 Bucher ..... A61H 23/0254 601/61
4,873,966 A * 10/1989 Gitter ..... A61H 15/00 601/63
D330,597 S 10/1992 Teranishi
5,411,469 A 5/1995 Wang
6,149,611 A 11/2000 Chen
6,210,349 B1 * 4/2001 Naruse ..... A61H 15/0078 601/127
6,405,390 B2 6/2002 Kuen
6,684,444 B2 2/2004 Wheeler
7,426,757 B2 9/2008 Lev
2003/0126679 A1 7/2003 Eun
2007/0038165 A1 * 2/2007 Trandafir ..... A61H 1/005 601/51
2007/0050906 A1 3/2007 Cohen
2007/0282229 A1 * 12/2007 Yuan ..... A61H 9/0078 601/55

(Continued)

FOREIGN PATENT DOCUMENTS

WO 2004024052 8/2005

*Primary Examiner* — Valerie L Woodward
*Assistant Examiner* — Paige Kathleen Bugg
(74) *Attorney, Agent, or Firm* — Kyle A. Fletcher, Esq.

(57) ABSTRACT

The foot-massaging device is a medical device adapted for use with a patient. The foot-massaging device is adapted for use with the left foot and the right foot of the patient. The foot-massaging device is adapted for use with the person lying in a prone position. The foot-massaging device massages, warms and provides therapeutic services to both the left foot and the right foot. The foot-massaging device comprises a chevron, a left foot apparatus, a right foot apparatus, and a control system. The left foot apparatus, the right foot apparatus, and the control system are mounted on the chevron. The left foot apparatus and the right foot apparatus massages, warms and provides electrical stimulation to the left foot and the right foot respectively.

18 Claims, 7 Drawing Sheets

(56) References Cited

U.S. PATENT DOCUMENTS

2010/0036296 A1* 2/2010 Sancho Serrats ..... A63B 23/08
601/31

* cited by examiner

FOOT-MASSAGING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary sciences, more specifically, a physical therapy apparatus.

SUMMARY OF INVENTION

The foot-massaging device is a medical device adapted for use with a patient. The foot-massaging device is adapted for use with the left foot and the right foot of the patient. The foot-massaging device is adapted for use with the person lying in a prone position. The foot-massaging device massages, warms and provides therapeutic services to both the left foot and the right foot. The foot-massaging device comprises a chevron, a left foot apparatus, a right foot apparatus, and a control system. The left foot apparatus, the right foot apparatus, and the control system are mounted on the chevron. The left foot apparatus and the right foot apparatus massages, warms and provides electrical stimulation to the left foot and the right foot respectively.

These together with additional objects, features and advantages of the foot-massaging device will be readily apparent to those of ordinary skill in the art upon reading the following detailed description of the presently preferred, but nonetheless illustrative, embodiments when taken in conjunction with the accompanying drawings.

In this respect, before explaining the current embodiments of the foot-massaging device in detail, it is to be understood that the foot-massaging device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the foot-massaging device.

It is therefore important that the claims be regarded as including such equivalent construction insofar as they do not depart from the spirit and scope of the foot-massaging device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
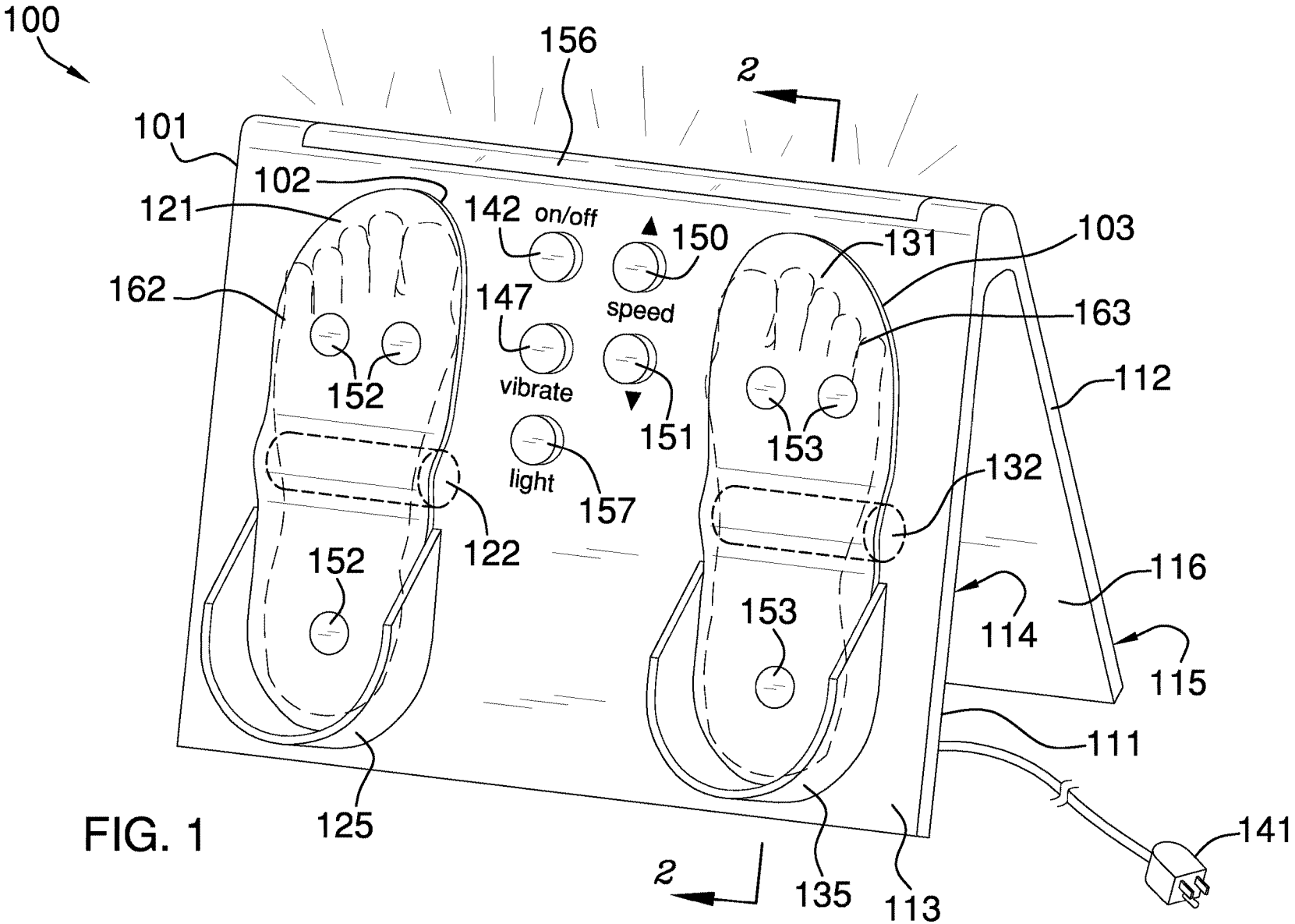
FIG. 1 is a perspective view of an embodiment of the disclosure.
Figure 2:
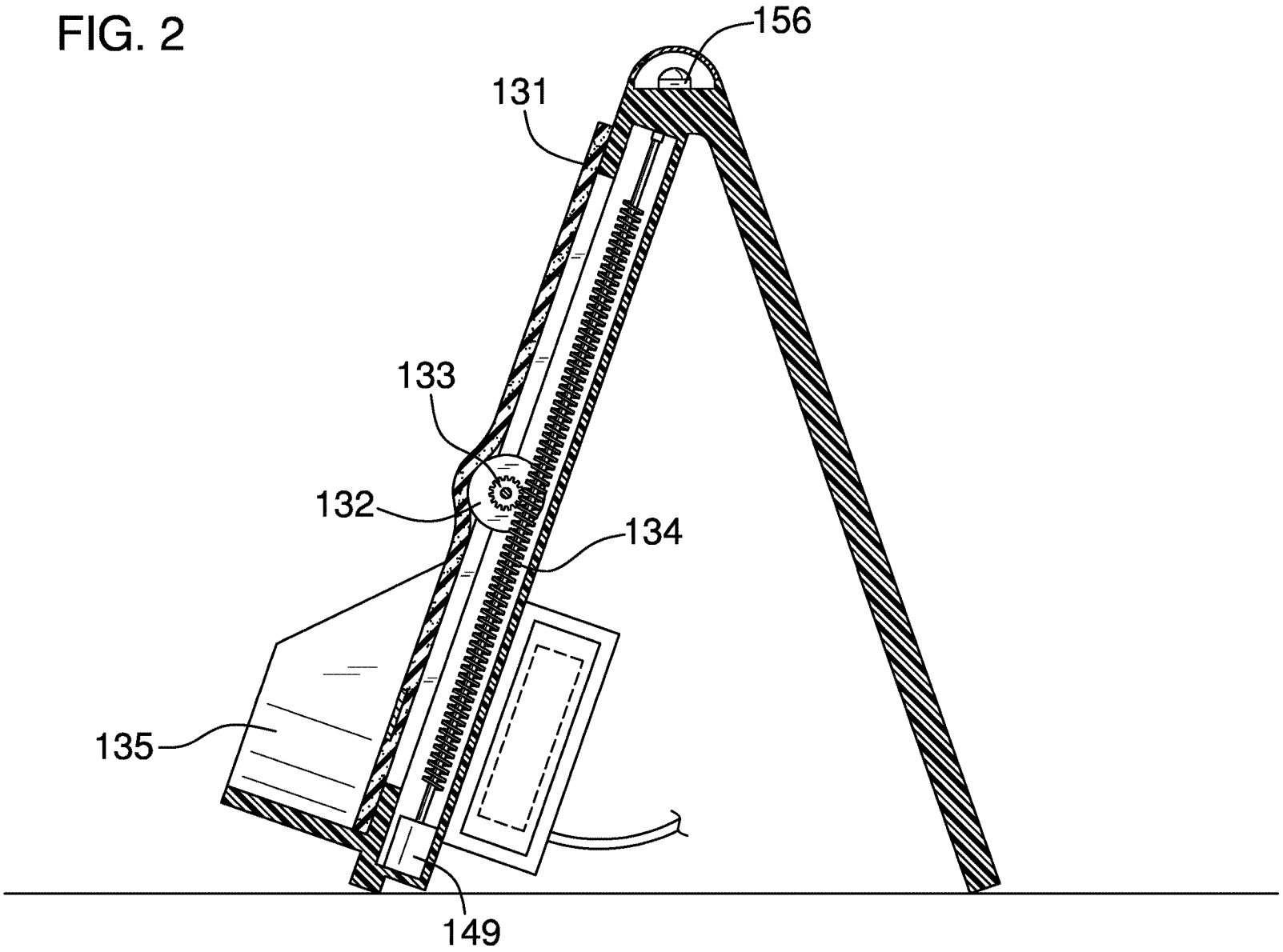
FIG. 2 is a cross-sectional view of an embodiment of the disclosure across 2-2 as shown in FIG. 1.
Figure 3:
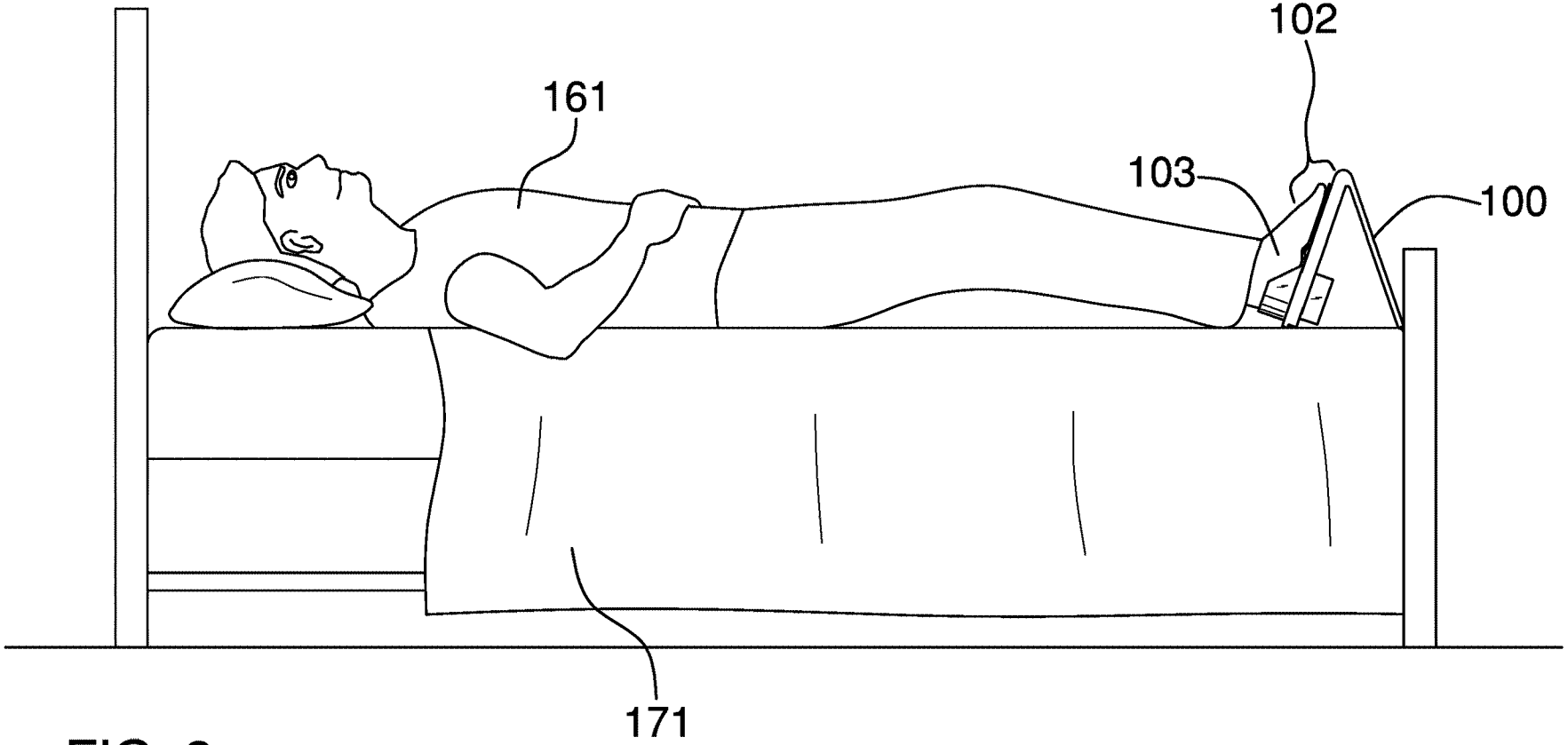
FIG. 3 is a front view of an embodiment of the disclosure.
Figure 4:
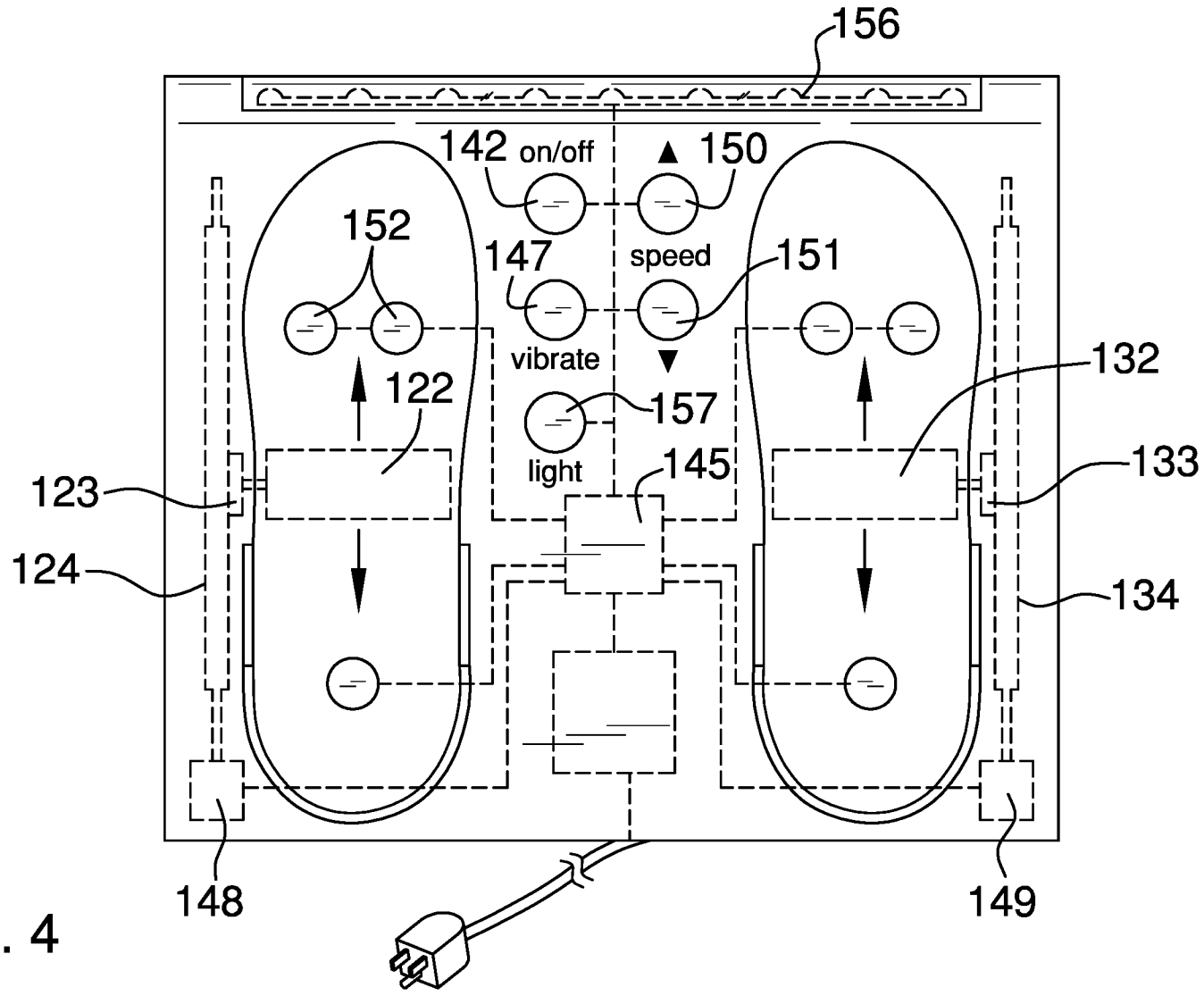
FIG. 4 is an in use view of an embodiment of the disclosure.
Figure 5:
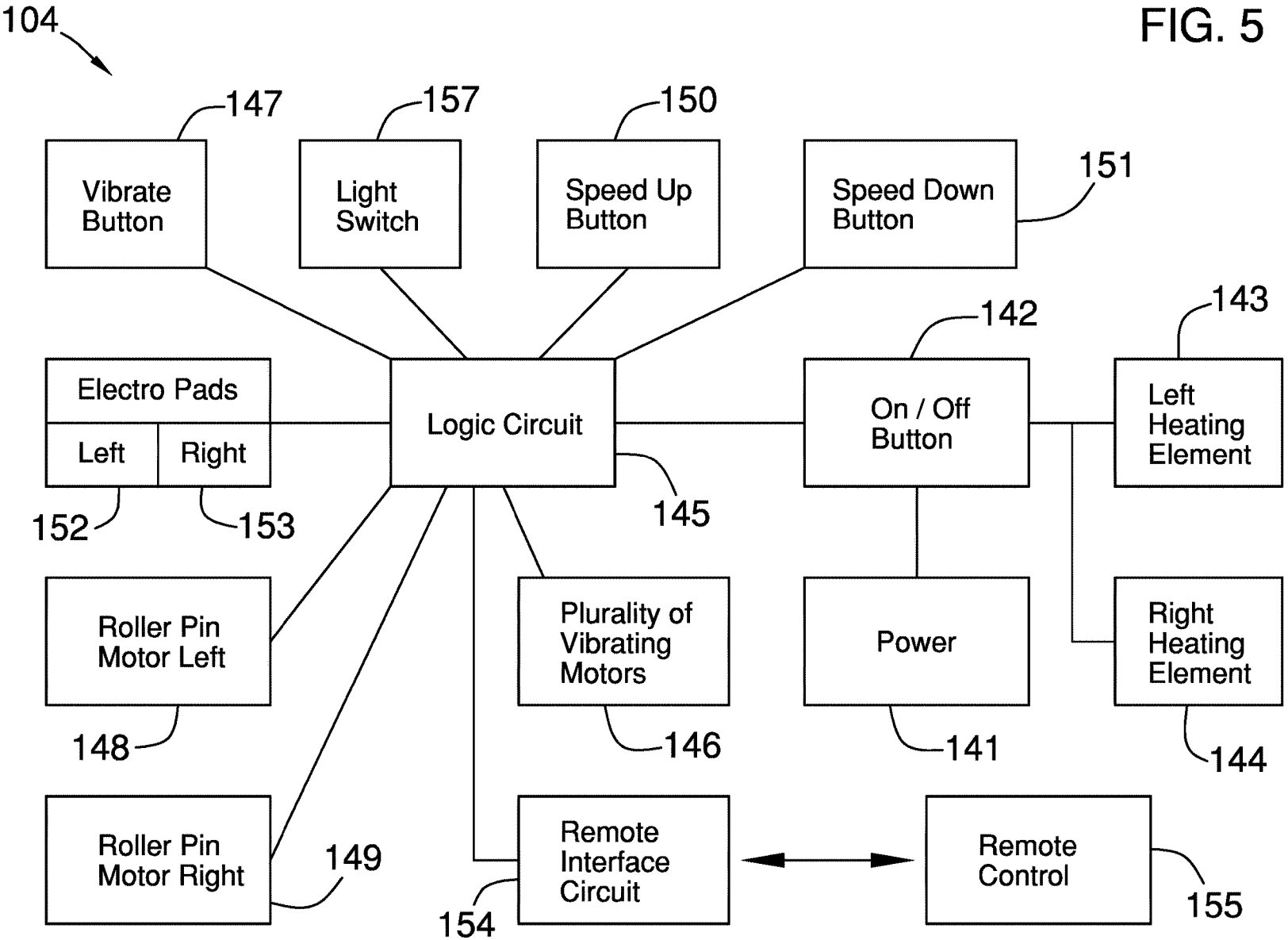
FIG. 5 is a block diagram of an embodiment of the disclosure.
Figure 6:
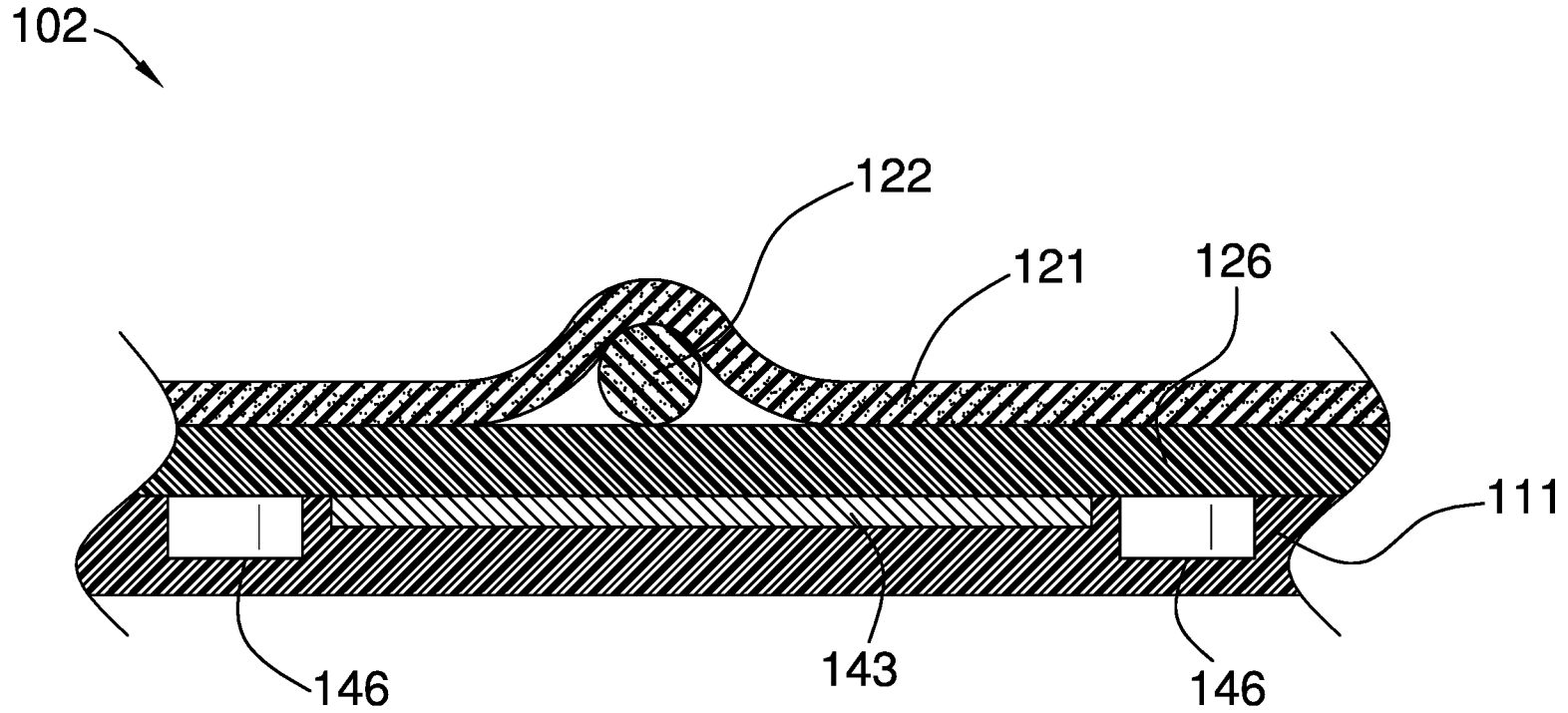
FIG. 6 is a detail view of an embodiment of the disclosure.
Figure 7:
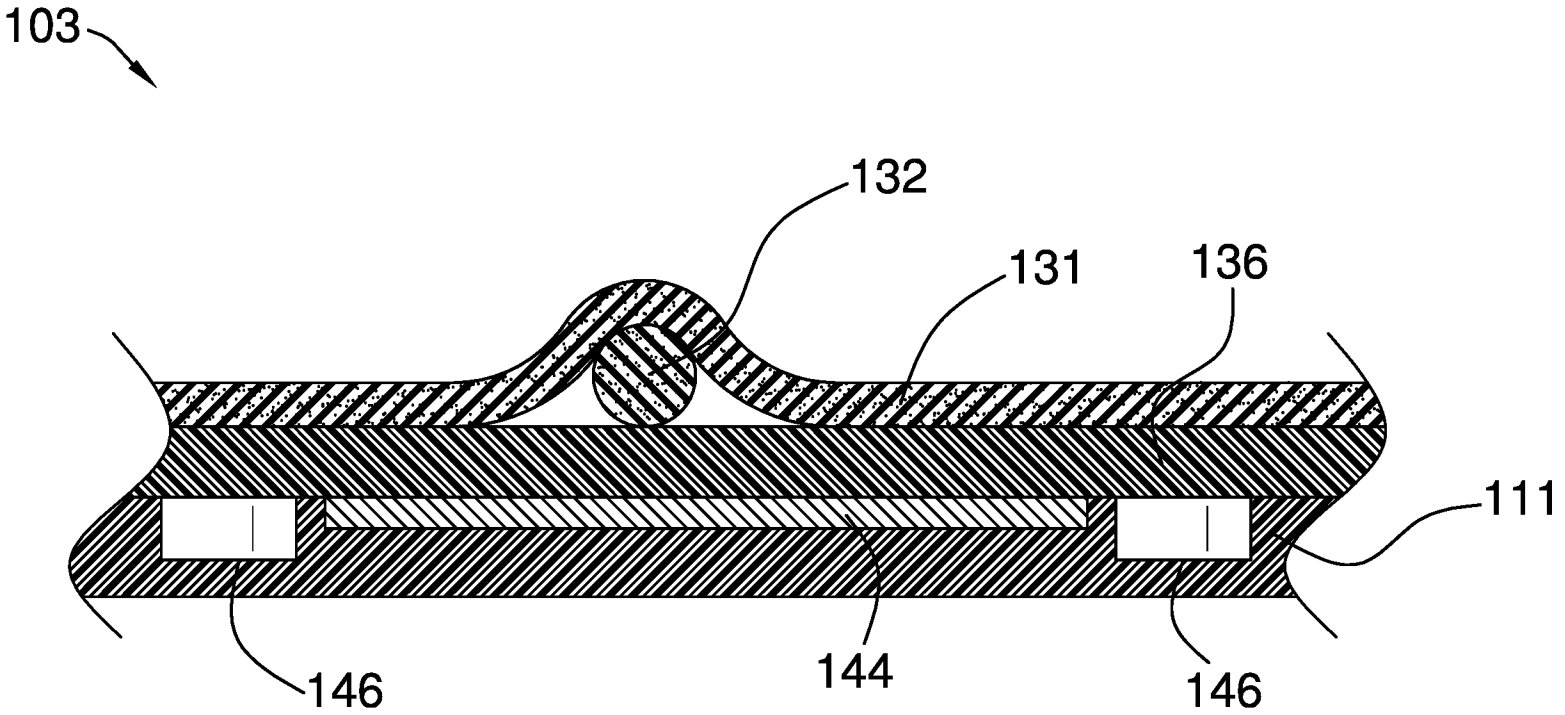
FIG. 7 is a detail view of an embodiment of the disclosure.

Detailed reference will now be made to one or more potential embodiments of the disclosure, which are illustrated in FIGS. 1 through 7.

The foot-massaging device 100 (hereinafter invention) is a medical device adapted for use with a patient 161. The patient 161 refers to a person designated to receive therapeutic treatment from the invention 100. The left foot 162 refers to the left foot 162 of the patient 161. The right foot 163 refers to the right foot 163 of the patient 161. The invent 100 is adapted for use with the left foot 162 and the right foot 163 of the patient 161. The invention 100 is adapted for use with the person lying in a prone position. The invention 100 massages, warms and provides therapeutic services to both the left foot 162 and the right foot 163. The invention 100 comprises a chevron 101, a left foot apparatus 102, a right foot apparatus 103, and a control system 104. The left foot apparatus 102, the right foot apparatus 103, and the control system 104 are mounted on the chevron 101. The left foot apparatus 102 and the right foot apparatus 103 massages, warms and provides electrical stimulation to the left foot 162 and the right foot 163 respectively.

The chevron 101 is a self-standing V shaped structure. The chevron 101 is formed as a single unit. When in use, the chevron 101 is positioned on a supporting surface in the manner of an inverted V. The left foot apparatus 102, the right foot apparatus 103, and the control system 104 are mounted on the chevron 101. The chevron 101 is intended to stand on the mattress or foot of a bed 171. This allows the patient 161 to take a prone position in the bed 171 while receiving therapy from the invention 100.

The chevron 101 comprises a first arm 111, a second arm 112. The first arm 111 is further defined with a first outer surface 113 and a first inner surface 115. The second arm 112 is further defined with a second outer surface 114 and a second inner surface 116. The first outer surface 113 of the first arm 111 is the distal surface from the second inner surface 116 of the second arm 112. The first inner surface 115 of the first arm 111 faces the second inner surface 116 of the second arm 112. The second outer surface 114 of the second arm 112 is the distal surface from the first inner surface 115 of the first arm 111. The second inner surface 116 of the second arm 112 faces the first inner surface 115 of the first arm 111.

The first arm 111 is a rectangular plate structure that forms one of the arms of the V of the chevron 101. The second arm 112 is a rectangular plate structure that forms one of the arms of the V of the chevron 101. The first arm 111 and the second arm 112 have identical dimensions within manufacturing tolerances.

The left foot apparatus 102 is the device that provides therapeutic massage to the left foot 162 of the patient 161. The left foot apparatus 102 is mounted on the first arm 111 of the chevron 101. The left foot apparatus 102 comprises a left foot pad 121, a left roller 122, a left roller gear 123, a left worm drive cylinder 124, a left heel support 125, and a left vibration plate 126.

The left foot pad 121 is a cushion that is formed in the shape of a left foot 162. In the first potential embodiment of the disclosure, the left foot pad 121 is formed from a polyurethane foam.

The left roller 122 is a cylindrical shaft. The left roller 122 rolls cyclically between the anterior and the posterior of the left foot 162 for the purpose of kneading the muscles on the inferior side of the left foot 162. The left roller 122 is positioned between the left vibration plate 126 and the left foot pad 121.

The left roller gear 123 is a commercially available gear that is attached to an end of the left roller 122. The left roller gear 123 is driven by the left worm drive cylinder 124. The left worm drive cylinder 124 is a cylindrical structure formed with an exterior screw thread. The left worm drive cylinder 124 is often referred to as a worm gear.

The left heel support 125 is a U shaped shelf structure that is intended to provide horizontal support to the posterior side of the left foot 162.

The left vibration plate 126 is a rectangular metal plate that is attached to the first outer surface 113 of the first arm 111. The left vibration plate 126 is used as a heat transfer medium to distribute heat from the left heating element 143 to the entire inferior surface of the left foot 162. One or more vibrating motors selected from the plurality of vibrating motors 146 are mounted on the left vibration plate 126. The stiffness of the metal in the left vibration plate 126 allows the vibrations generated by the selected one or more vibrating motors to be transmitted to the inferior surface of the left foot 162.

Methods to form the left foot apparatus 102 as described above are well known and documented in the mechanical arts.

The right foot apparatus 103 is the device that provides therapeutic massage to the right foot 163 of the patient 161. The left foot apparatus 102 and the right foot apparatus 103 operate in essentially the same manner. The physical appearance of the right foot apparatus 103 is a mirror image of the left foot apparatus 102. The right foot apparatus 103 is mounted on the first arm 111 of the chevron 101. The right foot apparatus 103 comprises a right foot pad 131, a right roller 132, a right roller gear 133, a right worm drive 134, a right heel support 135, and a right vibration plate 136.

The right foot pad 131 is a cushion that is formed in the shape of a right foot 163. In the first potential embodiment of the disclosure, the right foot pad 131 is formed from a polyurethane foam.

The right roller 132 is a cylindrical shaft. The right roller 132 rolls cyclically between the anterior and the posterior of the right foot 163 for the purpose of kneading the muscles on the inferior side of the right foot 163. The right roller 132 is positioned between the right vibration plate 136 and the right foot pad 131.

The right roller gear 133 is a commercially available gear that is attached to an end of the right roller 132. The right roller gear 133 is driven by the right worm drive 134. The right worm drive 134 is a cylindrical structure formed with an exterior screw thread. The right worm drive 134 is often referred to as a worm gear.

The right heel support 135 is a U shaped shelf structure that is intended to provide horizontal support to the posterior side of the right foot 163.

The right vibration plate 136 is a rectangular metal plate that is attached to the first outer surface 113 of the first arm 111. The right vibration plate 136 is used as a heat transfer medium to distribute heat from the right heating element 144 to the entire inferior surface of the right foot 163. One or more vibrating motors selected from the plurality of vibrating motors 146 are mounted on the right vibration plate 136. The stiffness of the metal in the right vibration plate 136 allows the vibrations generated by the selected one or more vibrating motors to be transmitted to the inferior surface of the right foot 163.

Methods to form the right foot apparatus 103 as described above are well known and documented in the mechanical arts.

The control system 104 controls the operation of the left foot apparatus 102 and the right foot apparatus 103.

The control system 104 comprises a power source 141, a power switch 142, a left heating element 143, a right heating element 144, a logic circuit 145, a plurality of vibrating motors 146, a vibrate switch 147, a left worm gear motor 148, a right worm gear motor 149, a speed increase switch 150, a speed decrease switch 151, a left stimulating electrodes 152, a right stimulating electrodes 153, a remote interface circuit 154, and a remote control 155, a light 156, and a light switch 157. The power source 141, the power switch 142, the left heating element 143, the right heating element 144, the logic circuit 145, the plurality of vibrating motors 146, the vibrate switch 147, the left worm gear motor 148, the right worm gear motor 149, the speed increase switch 150, the speed decrease switch 151, the left stimulating electrodes 152, the right stimulating electrodes 153, the remote interface circuit 154, the remote control 155, the light 156 and the light switch 157 are electrically interconnected.

The power source 141 is an electrical device that receives electrical energy from an external power source and conditions the received electrical energy using circuits such as AC/DC converters to condition the received electrical energy for use by the control system 104. The methods and circuits required to condition electrical power are well known and documented in the electrical arts. In the first potential embodiment of the disclosure, the external power source is the national electric grid. In another embodiment, the power source 141 involves a rechargeable battery, which is recharged via the power source 141.

The power switch 142 is an electrical switch that: 1) provides power from the power source 141 to the control system 104; and, 2) provides power from the power source 141 to the left heating element 143 and the right heating element 144. The power switch 142 is the on/off switch of the invention 100.

The left heating element 143 is an electrically powered resistive heating device that attaches to and heats the left vibration plate 126. The right heating element 144 is an electrically powered resistive heating device that attaches to and heats the right vibration plate 136.

The logic circuit 145 is an electrical circuit that: 1) receives control signals from a plurality of switches; and, 2) in response to the control signals: a) operates the left worm gear motor 148 and the right worm gear motor 149; b) operates the left stimulating electrodes 152 and the right stimulating electrodes 153; and, 3) operates the plurality of vibrating motors 146.

Each of the plurality of vibrating motors 146 is a readily and commercially available electrical device that generates a vibration when a voltage is applied to it. Each of the plurality of vibrating motors 146 is attached to a vibration plate selected from the group consisting of the left vibration plate 126 and the right vibration plate 136. Each of the plurality of vibrating motors 146 is mounted in a cavity that is formed in the first outer surface 113 of the first arm 111.

The vibrate switch 147 is an electrical device. The vibrate switch 147 is a foot operated device that is mounted on the first outer surface 113 of the first arm 111. The vibrate switch 147 provides a control signal to the logic circuit 145 that is used to turn on and off the plurality of vibrating motors 146.

The left worm gear motor 148 is an electrical motor that: 1) is controlled by the logic circuit 145; and, 2) is used to rotate the left worm drive cylinder 124. The right worm gear motor 149 is an electrical motor that: 1) is controlled by the logic circuit 145; and, 2) is used to rotate the right worm drive 134.

The speed increase switch 150 is an electrical device. The speed increase switch 150 is a foot operated device that is mounted on the first outer surface 113 of the first arm 111. The speed increase switch 150 provides a control signal to the logic circuit 145 that is used to increase the rotational speed of the left worm gear motor 148 and the right worm gear motor 149. The speed decrease switch 151 is an electrical device. The speed decrease switch 151 is a foot operated device that is mounted on the first outer surface 113 of the first arm 111. The speed decrease switch 151 provides a control signal to the logic circuit 145 that is used to decrease the rotational speed of the left worm gear motor 148 and the right worm gear motor 149.

The left stimulating electrodes 152 comprises a plurality of electrodes that are mounted on the left foot pad 121 such that the inferior surface of the left foot 162 is in contact with the left stimulating electrodes 152. The logic circuit 145 applies a voltage to the left stimulating electrodes 152 such that a therapeutic electrical current will flow across the inferior surface of the left foot 162. The right stimulating electrodes 153 comprises a plurality of electrodes that are mounted on the right foot pad 131 such that the inferior surface of the right foot 163 is in contact with the right stimulating electrodes 153. The logic circuit 145 applies a voltage to the right stimulating electrodes 153 such that a therapeutic electrical current will flow across the inferior surface of the right foot 163.

The remote interface circuit 154 is a readily and commercially available plurality of relays that are controlled over a radio frequency. Each relay contained within the remote interface circuit 154 is controlled using radio frequency commands generated by the remote control 155. Each relay contained within the remote interface circuit 154 duplicates a control signal selected from the group consisting of 1) the control signal generated by the vibrate switch 147; 2) the control signal generated by the speed increase switch 150; and, 3) the control signal generated by the speed decrease switch 151.

The logic circuit 145 monitors the remote interface circuit 154 and responds to control signals in the same manner as it would to the control signals generated by the vibrate switch 147, the speed increase switch 150, and the speed decrease switch 151.

The remote control 155 is a radio frequency transmission device that is used to send radio frequency signals to the remote interface circuit 154 in order to operate the remote interface circuit 154.

The light 156 is a commercially available LED strip. The light 156 mounts on the first outer surface 113 of the first arm 111 of the chevron 101. The lamp 156 is used to illuminate the first outer surface 113 of the first arm 111. The light switch 157 is a maintained electrical switch. The light switch 157 mounts on the first outer surface 113 of the first arm 111 of the chevron 101. The light switch 157 controls the operation of the light 156.

In the first potential embodiment of the disclosure, the remote interface circuit 154 and the remote control 155 are commercially sources as a 433 MHz remote control switch and receiver kit.

The following definitions were used in this disclosure:

AC: As used in this disclosure, AC is an acronym for alternating current.

AC/DC Converter: As used in this disclosure, an AC/DC converter is an electrical device that converts an AC voltage into a DC voltage. Method to design and build AC/DC converters are well known in the electrical arts.

Anterior: As used in this disclosure, anterior is a term that is used to refer to the front, or face side, of a human body. When comparing two objects, the anterior object is the object that is closer to front, or face side, of the human body.

Chevron: As used in this disclosure, chevron is a term that is used to describe an object that has the shape of a U or a V.

Control System: As used in this disclosure, a control system is a first device or system that manages and regulates the behavior or operation of a second device or system.

Cushion: As used in this disclosure a cushion is a structure formed with a pad that is used to prevent injury or damage to a person or object.

DC: As used in this disclosure, DC is an acronym for direct current.

Electrode: As used in this disclosure, an electrode is an electrical conductor through which electric current enters or exits a non-metallic object that is incorporated into an electric circuit. Non-metallic object commonly used with electrodes would include, but are not limited to electrolytic solutions, semiconducting materials, or patients undergoing medical procedures.

Exterior Screw Thread: An exterior screw thread is a ridge wrapped around the outer surface of a tube in the form of a helical structure that is used to convert rotational movement into linear movement.

External Power Source: Refers to source of the energy that is externally provided to enable the operation of the present disclosure. Examples of external power sources include, but are not limited to, electrical power sources and compressed air sources.

Heating Element: As used in this disclosure, a heating element is a resistive wire that is used to convert electrical energy into heat. Common metal combinations used to form heat elements include a combination of nickel and Chromium (typical: 80/20), a combination of iron, chromium and aluminum (typical 70/25/5), a combination of copper, nickel, iron, and manganese (typical 66/30/2/2) (use for continuously hot), or a platinum.

Inferior: As used in this disclosure, inferior refers to a directional sense or location of the body. Specifically, inferior refers to an object or a side of an object that is proximal to the feet or distal from the head of the body.

LED: As used in this disclosure, an LED is an acronym for a light emitting diode. A light emitting diode is a diode that is also a light source.

Light: As used in this disclosure, a light is an electrical device that generates visible light to illuminate objects so they can be seen.

Logic Circuit: As used in this disclosure, a logic circuit is an electrical device that receives one or more digital or analog inputs and uses those digital or analog inputs to generate one or more digital or analog outputs. The logic circuit may be programmable or non-programmable.

Maintained Switch: A used in this disclosure, a maintained switch is a switch that maintains the position that was set in the most recent switch actuation. A maintained switch works in an opposite manner to a momentary switch.

National Electric Grid: As used in this disclosure, the national electric grid is a synchronized and highly interconnected electrical network that distributes energy in the form of electric power from a plurality of generating stations to consumers of electricity.

Pad: As used in this disclosure, a pad is a mass of soft material used as a filling or for protection against damage or injury. Commonly used padding materials include, but are not limited to, polyurethane foam, a polyester fill often referred to as fiberfill or polystyrene beads often referred to as stuffing beans or as bean bag chair beans.

Patient: As used in this disclosure, a patient is a person who is designated to receive a medical treatment, therapy or service. The term patient may be extended to an animal when used within the context of the animal receiving veterinary treatment or services Posterior: As used in this disclosure, posterior is a term that is used to refer to the side of a human body that is distal from the anterior side. When comparing two objects, the posterior object is the object that is distal from the anterior side of the human body.

Relay: As used in this disclosure, a relay is an automatic electromagnetic or electromechanical device that reacts to changes in voltage or current by opening or closing a switch in an electric circuit. Relays further defined with a coil and a switch. Applying a voltage to the coil, usually referred to as energizing the coil, will cause the coil to change the position of the switch. Note: Though transistors can be configured to perform switching functions, transistors used for switching functions are handled separately in this disclosure and are explicitly excluded from this definition.

Remote Control: As used in this disclosure, remote control means the establishment of control of a device from a distance. Remote control is generally accomplished through the use of an electrical device that generates electrically based control signals that are transmitted via radio frequencies or other means to the device.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Worm Drive: As used in this disclosure, a worm drive refers to a mechanical arrangement where a rotating cylinder further comprising an exterior screw thread is used to: 1) rotate a gear; or 2) move a plate formed with an interior screw thread in a linear fashion in the direction of the center axis of the rotating cylinder. Worm drives are also referred to as worm gears.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A therapeutic device comprising:

a chevron, a left foot apparatus, a right foot apparatus, and a control system;

wherein the left foot apparatus, the right foot apparatus, and the control system are mounted on the chevron;

wherein the control system controls the operation of the left foot apparatus and the right foot apparatus;

wherein the therapeutic device is a medical device;

wherein the therapeutic device is adapted for use with a patient having a left foot and a right foot;

wherein the therapeutic device is adapted for use with the left foot and the right foot of the patient;

wherein the therapeutic device is adapted for use with the patient lying in a prone position;

wherein the therapeutic device is adapted to massage warm, and provide therapeutic services to both the left foot and the right foot;

wherein the left foot apparatus and the right foot apparatus are adapted to massage, warm, and provide therapeutic services to the left foot and the right foot respectively;

wherein the chevron is a self-standing V shaped structure;

wherein the chevron is positioned on a supporting surface in the manner of an inverted V;

wherein the chevron comprises a first arm, and a second arm;

wherein the first arm and the second arm form the V of the chevron;

wherein the first arm and the second arm have identical dimensions;

wherein the first arm is further defined with a first outer surface and a first inner surface;

wherein the second arm is further defined with a second outer surface and a second inner surface;

wherein the first outer surface of the first arm is distal to the second inner surface of the second arm;

wherein the first inner surface of the first arm faces the second inner surface of the second arm;

wherein the second outer surface of the second arm is distal to the first inner surface of the first arm;

wherein the second inner surface of the second arm faces the first inner surface of the first arm;

wherein the first arm is a rectangular plate structure that forms one of the arms of the V of the chevron;

wherein the second arm is a rectangular plate structure that forms one of the arms of the V of the chevron;

wherein the left foot apparatus is adapted to provide therapeutic services to the left foot of the patient;

wherein the left foot apparatus is mounted on the first outer surface of the first arm of the chevron;

wherein the left foot apparatus comprises a left foot pad, a left roller, a left roller gear, a left worm drive cylinder, a left heel support, and a left vibration plate.

2. The therapeutic device according to claim 1 wherein the left foot pad is a cushion that is formed in the shape of a left foot;

wherein the left roller is a cylindrical shaft;

wherein the left roller is positioned between the left vibration plate and the left foot pad;

wherein the left roller gear is a gear that is attached to an end of the left roller;

wherein the left roller gear is driven by the left worm drive cylinder;

wherein the left worm drive cylinder is a cylindrical structure formed with an exterior screw thread;

wherein the left heel support is a U shaped shelf structure that provides horizontal support to a posterior side of the left foot;

wherein the left vibration plate is a rectangular metal plate that is attached to the first outer surface of the first arm.

3. The therapeutic device according to claim 2 wherein the left roller rolls cyclically between an anterior and the posterior of the left foot.

4. The therapeutic device according to claim 3 wherein the right foot apparatus is adapted to provide therapeutic services to the right foot of the patient;

wherein the right foot apparatus is mounted on the first outer surface of the first arm of the chevron;

wherein a physical appearance of the right foot apparatus is a mirror image of the left foot apparatus;

wherein right foot apparatus comprises a right foot pad, a right roller, a right roller gear, a right worm drive cylinder, a right heel support, and a right vibration plate.

5. The therapeutic device according to claim 4 wherein the right foot pad is a cushion that is formed in the shape of a right foot;

wherein the right roller is a cylindrical shaft;

wherein the right roller is positioned between the right vibration plate and the right foot pad;

wherein the right roller gear is a gear that is attached to an end of the right roller;

wherein the right roller gear is driven by the right worm drive cylinder;

wherein the right worm drive cylinder is a cylindrical structure formed with an exterior screw thread;

wherein the right heel support is a U shaped shelf structure that provides horizontal support to a posterior side of the right foot;

wherein the right vibration plate is a rectangular metal plate that is attached to the first outer surface of the first arm.

6. The therapeutic device according to claim 5 wherein the right roller rolls cyclically between an anterior and the posterior of the right foot.

7. The therapeutic device according to claim 6 wherein the control system comprises a power source, a power switch, a left heating element, a right heating element, a logic circuit, a plurality of vibrating motors, a vibrate switch, a left worm gear motor, a right worm gear motor, a speed increase switch, a speed decrease switch, a plurality of left stimulating electrodes, a plurality of right stimulating electrodes, a remote interface circuit, a remote control, a light, and a light switch;

wherein the power source, the power switch, the left heating element, the right heating element, the logic circuit, the plurality of vibrating motors, the vibrate switch, the left worm gear motor, the right worm gear motor, the speed increase switch, the speed decrease switch, the plurality of left stimulating electrodes, the plurality of right stimulating electrodes, the remote interface circuit, the remote control, the light, and the light switch are electrically interconnected.

8. The therapeutic device according to claim 7 wherein the power source is an electrical device;

wherein the power source receives electrical energy from an external power source and conditions the received electrical energy for use by the control system.

9. The therapeutic device according to claim 8 wherein the power switch is an electrical switch;

wherein the power switch provides power from the power source to the control system;

wherein the power switch provides power from the power source to the left heating element and the right heating element.

10. The therapeutic device according to claim 9 wherein the left heating element is an electrically powered resistive heating device that attaches to and heats the left vibration plate;

wherein the right heating element is an electrically powered resistive heating device that attaches to and heats the right vibration plate.

11. The therapeutic device according to claim 10 wherein the logic circuit is an electrical circuit;

wherein the logic circuit receives control signals from a plurality of switches;

wherein in response to the control signals the logic circuit operates the left worm gear motor and the right worm gear motor;

wherein in response to the control signals the logic circuit operates the plurality of left stimulating electrodes and the plurality of right stimulating electrodes;

wherein in response to the control signals the logic circuit operates the plurality of vibrating motors.

12. The therapeutic device according to claim 11 wherein each of the plurality of vibrating motors is an electrical device;

wherein each of the plurality of vibrating motors generates a vibration when a voltage is applied to it.

13. The therapeutic device according to claim 12 wherein each of the plurality of vibrating motors is mounted in a cavity that is formed in the first outer surface of the first arm.

14. The therapeutic device according to claim 13 wherein the vibrate switch is an electrical device;

wherein the vibrate switch is a foot operated device that is mounted on the first outer surface of the first arm;

wherein the vibrate switch provides a control signal to the logic circuit that is used to turn on and off the plurality of vibrating motors.

15. The therapeutic device according to claim 14 wherein the left worm gear motor is an electrical motor;

wherein the left worm gear motor rotates the left worm drive cylinder;

wherein the right worm gear motor is an electrical motor;

wherein the right worm gear motor rotates the right worm drive cylinder.

16. The therapeutic device according to claim 15 wherein the speed increase switch is an electrical device;

wherein the speed increase switch is a foot operated device that is mounted on the first outer surface of the first arm;

wherein the speed increase switch provides a control signal to the logic circuit that is used to increase a rotational speed of the left worm gear motor and the right worm gear motor;

wherein the speed decrease switch is an electrical device;

wherein the speed decrease switch is a foot operated device that is mounted on the first outer surface of the first arm;

wherein the speed decrease switch provides a control signal to the logic circuit that is used to decrease the rotational speed of the left worm gear motor and the right worm gear motor.

17. The therapeutic device according to claim 16 wherein the plurality of left stimulating electrodes comprises a plurality of electrodes that are mounted on the left foot pad such that the inferior surface of the left foot is in contact with the plurality of left stimulating electrodes;

wherein the logic circuit applies a voltage to the plurality of left stimulating electrodes such that a therapeutic electrical current will flow across an inferior surface of the left foot;

wherein the plurality of right stimulating electrodes comprises a plurality of electrodes that are mounted on the right foot pad such that the inferior surface of the right foot is in contact with the plurality of right stimulating electrodes;

wherein the logic circuit applies a voltage to the plurality of right stimulating electrodes such that a therapeutic electrical current will flow across an inferior surface of the right foot.

18. The therapeutic device according to claim 17 wherein the remote control circuit comprises a plurality of relays;

wherein the remote control is a radio frequency transmission device that is used to send radio frequency signals to the remote interface circuit in order to operate the relays contained within the remote interface circuit;

wherein each relay contained within the remote interface circuit duplicates a control signal selected from the group consisting of 1) the control signal generated by the vibrate switch; 2) the control signal generated by the speed increase switch; and, 3) the control signal generated by the speed decrease switch;

wherein the logic circuit monitors the remote interface circuit and responds to control signals in the same manner as the control signals generated by the vibrate switch, the speed increase switch, and the speed decrease switch.

* * * * *